US010501161B2

(12) United States Patent
Tamura et al.

(10) Patent No.: US 10,501,161 B2
(45) Date of Patent: Dec. 10, 2019

(54) SHIP STEERING DEVICE AND SHIP INCLUDING THE SAME

(71) Applicant: Yanmar Co., Ltd., Osaka-shi, Osaka-fu (JP)

(72) Inventors: Gakuji Tamura, Osaka (JP); Jun Watanabe, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 16/087,916

(22) PCT Filed: Mar. 24, 2017

(86) PCT No.: PCT/JP2017/012119

§ 371 (c)(1),
(2) Date: Sep. 24, 2018

(87) PCT Pub. No.: WO2017/164393

PCT Pub. Date: Sep. 28, 2017

(65) Prior Publication Data

US 2019/0092444 A1 Mar. 28, 2019

(30) Foreign Application Priority Data

Mar. 25, 2016 (JP) ..... 2016-061988

(51) Int. Cl.
*B63H 25/42* (2006.01)
*B63H 25/02* (2006.01)
(Continued)

(52) U.S. Cl.
CPC ..... *B63H 25/42* (2013.01); *B63H 21/21* (2013.01); *B63H 25/02* (2013.01); *B63H 5/08* (2013.01);
(Continued)

(58) Field of Classification Search
CPC ..... B63H 25/42; B63H 25/02; B63H 25/04; B63H 21/21; B63H 21/24; B63H 5/08; B63H 2021/216
See application file for complete search history.

(56) References Cited

U.S. PATENT DOCUMENTS 8,060,265 B2 * 11/2011 Hallenstvedt ..... B63H 5/10 114/114
8,234,024 B2 * 7/2012 Nose ..... B63H 25/42 114/144 RE
(Continued)

FOREIGN PATENT DOCUMENTS

JP 2011-140272 A 7/2011
JP 5764411 B2 8/2015
WO 2015/114781 A1 8/2015

OTHER PUBLICATIONS

International Search Report dated Jun. 13, 2017 issued in corresponding PCT Application PCT/JP2017/012119.

*Primary Examiner* — Stephen P Avila
(74) *Attorney, Agent, or Firm* — Norton Rose Fulbright US LLP

(57) ABSTRACT

A ship steering device including: an engine; an auto-drive unit that exerts propulsive power on a ship hull by power from the engine; detection means for detecting a current position and an orientation of the ship hull; a ship steering control device that controls an output of the engine and propulsive power of the auto-drive unit; and a calibration switch that starts calibration of a ship. When the ship steering control device detects that the calibration switch is turned on, the ship steering control device controls the engine and the auto-drive unit to cause the ship hull to move in a predetermined direction or to turn, and if a difference between, for instance, a traveling amount and speed in the predetermined direction and an intended traveling amount
(Continued)

and speed exceeds a predetermined value, the ship steering control device corrects control values of the engine and the auto-drive unit.

4 Claims, 6 Drawing Sheets

(51) Int. Cl.

| | |
|---|---|
| ***B63H 21/21*** | (2006.01) |
| *B63H 25/04* | (2006.01) |
| *B63H 5/08* | (2006.01) |
| *B63H 21/00* | (2006.01) |

(52) U.S. Cl.
CPC ..... *B63H 21/24* (2013.01); *B63H 25/04* (2013.01); *B63H 2021/216* (2013.01)

(56) References Cited

U.S. PATENT DOCUMENTS

| | | | | |
|---|---|---|---|---|
| 8,589,004 | B1 * | 11/2013 | Kanno ..... | B63H 25/42 701/21 |
| 9,126,667 | B2 * | 9/2015 | Mizutani ..... | B63H 21/21 |
| 2011/0166724 | A1 | 7/2011 | Hiramatsu | |
| 2014/0156124 | A1 | 6/2014 | Hara et al. | |
| 2016/0340013 | A1 | 11/2016 | Hayashi et al. | |

* cited by examiner

SHIP STEERING DEVICE AND SHIP INCLUDING THE SAME

CROSS REFERENCES TO RELATED APPLICATIONS

This application is a national stage application pursuant to 35 U.S.C. § 371 of International Application No. PCT/JP2017/012119, filed on Mar. 24, 2017, which claims priority under 35 U.S.C. § 119 to Japanese Patent Application No. 2016-061988 filed on Mar. 25, 2016, the disclosures of which are hereby incorporated by reference in their entireties

TECHNICAL FIELD

The present invention relates to a ship steering device and a ship including the ship steering device, and particularly to a calibration automation technique for an engine and a propulsion unit in a ship steering device.

BACKGROUND ART

Patent Literature 1 (PTL 1) discloses a calibration technique with which an operator manipulates a joystick to move a ship laterally or obliquely, and if the direction of movement of the ship is different from an intended direction, a rotation angle or an output of a propulsion unit is corrected.

CITATION LIST

Patent Literature

PTL 1: Japanese Patent No. 5764411

SUMMARY OF INVENTION

Technical Problem

In a calibration technique employed to date, an operator actually manipulates an operation means such as an accelerator lever or a joystick, and while comparing the amount of the manipulation with an actual operation of a ship, further manipulates the operation means or manipulates another manipulation means at the same time. That is, the operator conducts complicated work.

Some aspects of the present invention can provide a technique that enables automatic calibration of a ship only by operator's manipulation of manipulation means for starting calibration without actually manipulating the manipulation means for calibration.

Solution to Problem

A ship steering device according to an aspect of the present invention includes: an engine; a propulsion unit that exerts propulsive power on a ship hull by power from the engine; detection means for detecting a current position and an orientation of the ship hull; a control device that controls an output of the engine and propulsive power of the propulsion unit; and manipulation means that starts calibration of a ship, wherein when the control device detects that the manipulation means is turned on, the control device controls the engine and the propulsion unit to cause the ship hull to move in a predetermined direction or to turn, and if a difference between a traveling amount and a travelling speed or a turning amount and a turning speed in the predetermined direction and an intended traveling amount and an intended traveling speed or an intended turning amount and an intended turning speed exceeds a predetermined value, the control device corrects control values of the engine and the propulsion unit.

The ship steering device may include manipulation means including an accelerator device that changes the number of revolutions of the engine, and the control device may simulate manipulation of the accelerator device to control the engine and the propulsion unit, and based on a correlation among an amount of the simulated manipulation of the accelerator device and a traveling amount and a traveling speed of the ship hull, the control device may correct a control value of the engine.

A ship according to an aspect of the present invention includes the ship steering device described above.

Advantageous Effects of Invention

According to some aspects of the present invention, it is possible for an operator to automatically perform calibration of a ship only by manipulating manipulation means for starting calibration without actually manipulating the manipulation means for calibration.

DESCRIPTION OF EMBODIMENT

Figure 1:
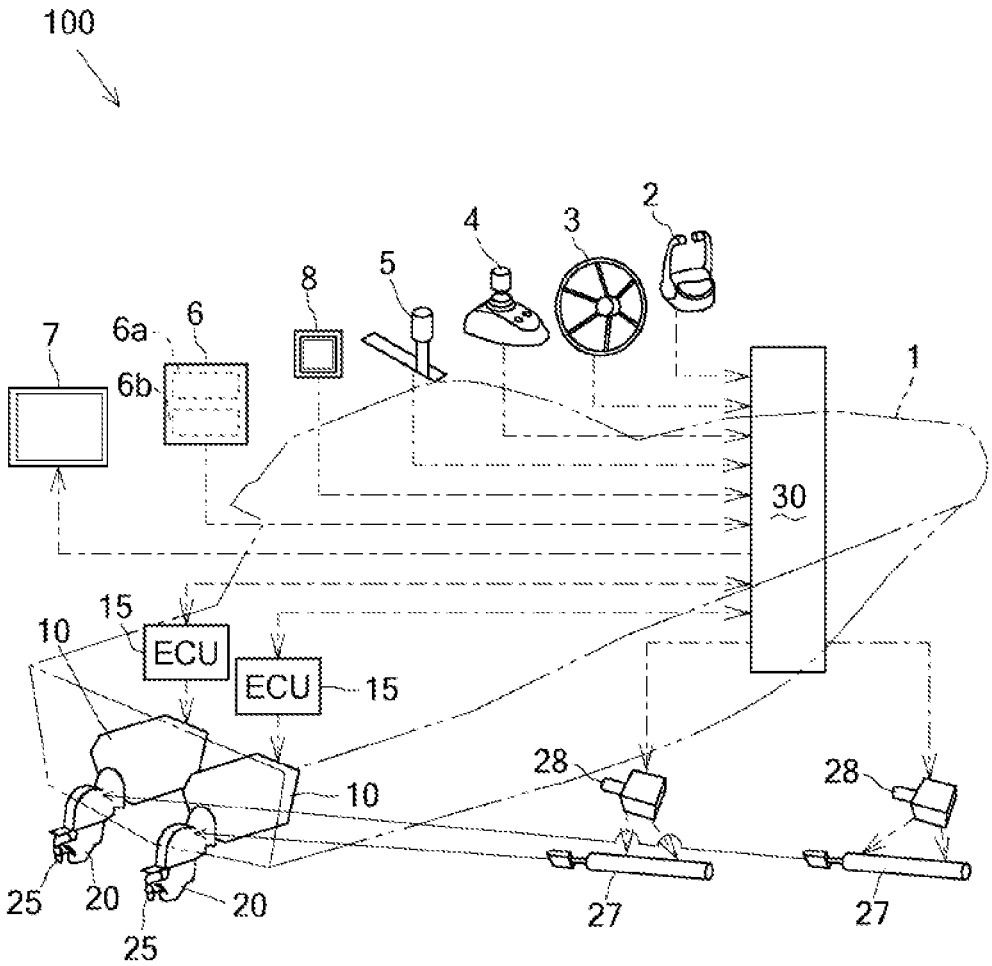
FIG. 1 An illustration of a basic configuration of a ship.
Figure 2:
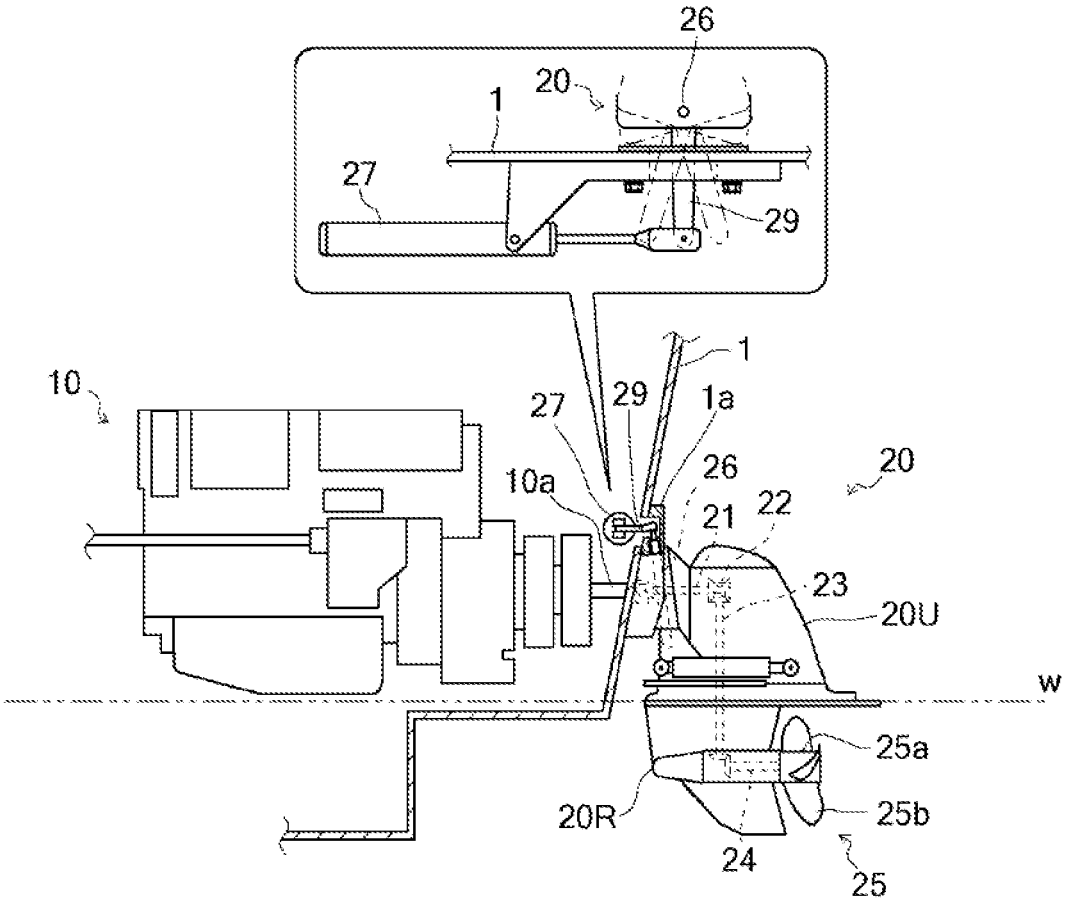
FIG. 2 A view illustrating an engine and an auto-drive unit.

A ship 100 will be described with reference to FIGS. 1 and 2. The ship 100 according to this embodiment is a so-called twin propeller ship, but the number of propeller shafts is not limited to two, and the ship only needs to include a plurality of shafts.

The ship 100 includes a ship hull 1 including two engines 10 and two auto-drive units 20. The auto-drive units 20 as propulsion units are driven by the engines 10, and propulsive power is exerted on the ship hull 1 by rotating propulsive propellers 25 of the propeller auto-drive units 20. The ship hull 1 includes an accelerator lever 2, a steering 3, a joystick lever 4, and a shift lever 5, for example, as manipulation tools for manipulating the ship 100. In accordance with manipulation of these manipulation tools, operating statuses of the engines 10, propulsive power from the auto-drive units 20 and directions of action of the propulsive power are controlled.

In this embodiment, the ship 100 is a stern drive ship including two engines 10 and two auto-drive units 20, but is not limited such a type, and may be, for example, a shaft ship including a plurality of propeller shafts and including a thruster, such as a bow thruster or a stern thruster, as an auxiliary propulsion unit.

By manipulating the steering 3 or the joystick lever 4 of the ship hull 1, output directions of the auto-drive units 20 can be changed so that the traveling direction of the ship 100 can be changed. The ship hull 1 includes a ship steering control device 30 for steering control of the ship 100.

The ship hull 1 includes the steering 3, the joystick lever 4, the shift lever 5 as manipulation means for controlling the auto-drive units 20 for ship steering. The ship hull 1 and also includes a GNSS device 6*a* for detecting a current position and a traveling speed of the ship hull 1 and a heading sensor 6*b* for detecting an orientation of the ship hull 1, as detection means 6 for detecting the current position, a bow position, and the traveling speed of the ship hull 1. The GNSS device 6*a* acquires the current position of the ship hull 1 at each predetermined time using a global navigation satellite system to thereby detect the travelling speed and the travelling direction based on a positional shift in addition to the current position of the ship hull 1. A turning speed is detected based on a change rate of the orientation detected by the heading sensor 6*b* per a unit time. The ship hull 1 also includes a monitor 7 that displays, for example, a manipulation status of the manipulation tools and a detection result of the detection means 6, and is disposed near the steering 3, for example.

In this embodiment, the current position, the orientation, and the traveling speed, for example, of the ship hull 1 are detected by the detection means 6 including the GNSS device 6*a* and the heading sensor 6*b*, but the present invention is not limited to this example. For example, the detection may be individually performed by a GNSS device for detecting the current position of the ship hull, a gyro sensor for detecting the orientation of the ship hull, and an electromagnetic log for detecting a speed of the ship hull through the water, or all the current position, the orientation, and the traveling speed, for example, may be detected only by the GNSS device.

An ECU 15 is disposed in each of the engines 10 and used for controlling the engine 10. The ECU 15 stores various programs and data for controlling the engine 10. The ECU 15 may have a configuration in which a CPU, a ROM, a RAM, an HDD, and so forth are connected by a bus, or may be constituted by, for example, a one-chip LSI.

The ECU 15 is electrically connected to various sensors for detecting operating statuses of a fuel adjusting value of an unillustrated fuel feed pump, a fuel injection valve, and various devices in the engine 10. The ECU 15 controls a feed rate of the fuel adjusting value and opening/closing the fuel injection valve, and acquires information detected by the sensors.

Each of the auto-drive units 20 exerts propulsive power on the ship hull 1 by rotating the propulsive propellers 25. The auto-drive unit 20 includes an input shaft 21, a switching clutch 22, a driving shaft 23, an output shaft 24, and the propulsive propellers 25. In this embodiment, one auto-drive unit 20 is cooperatively coupled to one engine 10. The number of auto-drive units 20 for one engine 10 is not limited to the number described in this embodiment. The drive device is not limited to the auto-drive units 20 of this embodiment, and may be a device in which propellers are driven directly or indirectly by the engine or may be of a POD type.

The input shaft 21 transfer rotary power of the engine 10 to the switching clutch 22. One end of the input shaft 21 is coupled to a universal joint attached to the output shaft 10*a* of the engine 10, and the other end of the input shaft 21 is coupled to the switching clutch 22 disposed inside an upper housing 20U.

The switching clutch 22 can switch rotary power of the engine 10 transferred through, for example, the input shaft 21 between a normal direction and a reverse direction. The switching clutch 22 includes a normal rotation bevel gear coupled to an inner drum including disc plates, and a reverse rotation bevel gear. The switching clutch 22 transfers power by pressing a pressure plate of an outer drum coupled to the input shaft 21 against one of the disc plates. Then the switching clutch 22 is in a half-clutch state in which the pressure plate is imperfectly pressed against one of the disc plates so that rotary power of the engine 10 can be partially transferred to the propulsive propellers 25, and when the switching clutch 22 is in a neutral position in which the pressure plate is not pressed against any of the disc plates so that rotary power of the engine 10 cannot be transferred to the propulsive propellers 25.

The driving shaft 23 transfers rotary power of the engine 10 transferred through, for example, the switching clutch 22, to the output shaft 24. A bevel gear disposed at one end of the driving shaft 23 meshes with the normal rotation bevel gear and the reverse rotation bevel gear of the switching clutch 22, and a bevel gear disposed at the other end of the driving shaft 23 meshes with a bevel gear of the output shaft 24 disposed inside a lower housing 20R.

The output shaft 24 transfers rotary power of the engine 10 transferred through, for example, the driving shaft 23, to the propulsive propellers 25. A bevel gear disposed at one end of the output shaft 24 meshes with the bevel gear of the driving shaft 23 as described above, and the other end of the output shaft 24 is provided with the propulsive propellers 25.

The propulsive propellers 25 generate propulsive power by rotation. The propulsive propellers 25 are driven by rotary power of the engine 10 transferred through, for example, the output shaft 24, and generate propulsive power by paddling surrounding water by a plurality of blades 25*b* arranged around a rotational shaft 25*a*.

Each of the auto-drive units 20 is supported by a gimbal housing 1*a* attached to a quarter board (transom board) of the ship hull 1. Specifically, each of the auto-drive units 20 is supported by the gimbal housing 1*a* in such a manner that a gimbal ring 26 as a rotation fulcrum shaft is substantially perpendicular to a waterline w.

An upper portion of the gimbal ring 26 extends into the gimbal housing 1*a* (ship hull 1), and a steering arm 29 is attached to the upper end of the gimbal ring 26. Then the steering arm 29 is rotated, the gimbal ring 26 rotates, and the auto-drive unit 20 rotates about the gimbal ring 26. The steering arm 29 is driven by a hydraulic actuator 27 that is actuated in cooperation with manipulation of the steering 3 or the joystick lever 4. The hydraulic actuator 27 is controlled by an electromagnetic proportional control valve 28 that switches a flow direction of hydraulic fluid in accordance with manipulation of the steering 3 or the joystick lever 4.

As described above, the ship hull 1 of the ship 100 includes the engines 10, the auto-drive units 20, the detection means 6 for detecting a steering state of the ship hull 1, the manipulation tools, a calibration switch 8 as manipulation means for starting calibration described later, and the ship steering control device 30 connected to these devices and configured to perform steering control of the ship 100 by an appropriate control method. The engines 10, the auto-drive units 20, the detection means 6, the ship steering control device 30, and the calibration switch 8 constitute a ship steering device.

Figure 3:
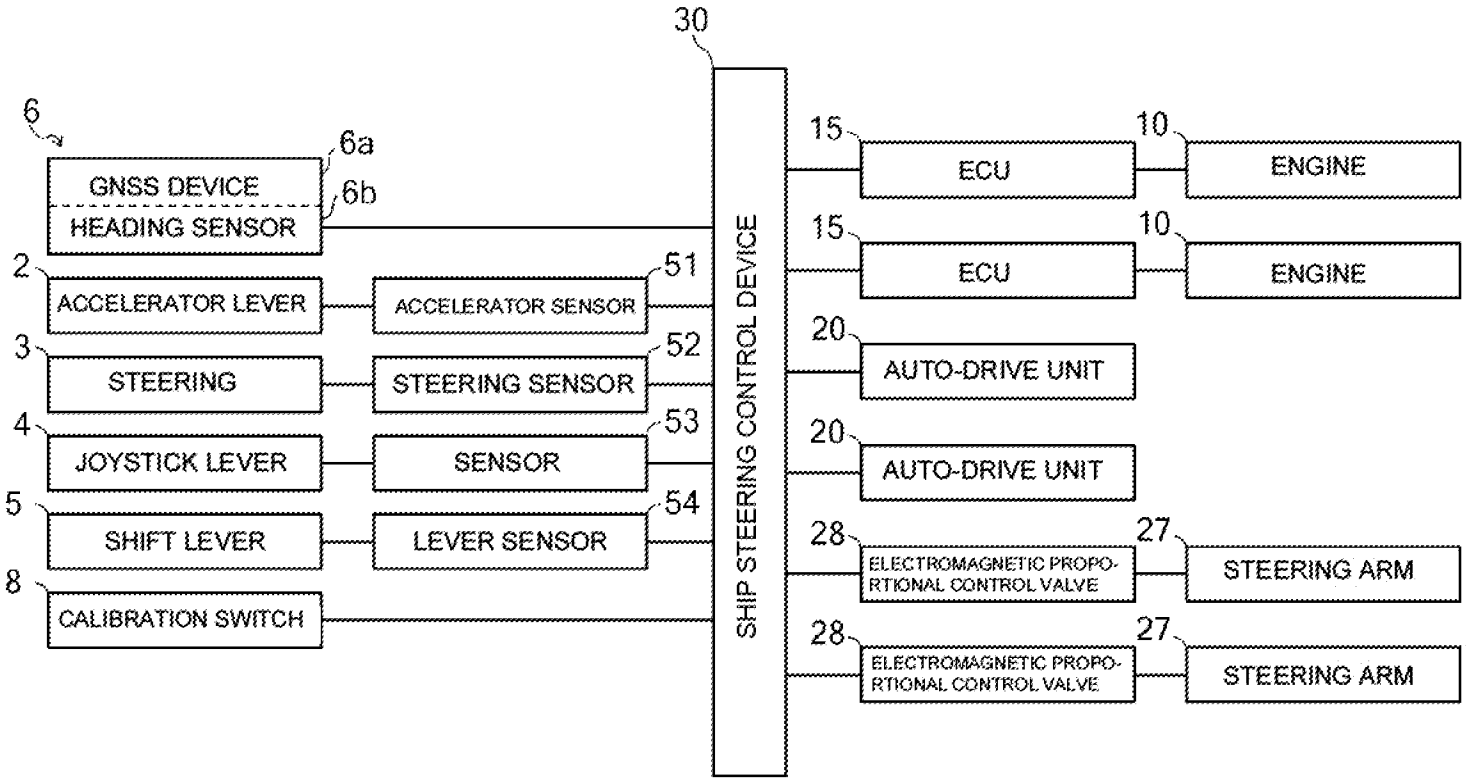
FIG. 3 A block diagram of steering control.

A steering control configuration of a ship by the ship steering control device will now be described with reference to FIG. 3. As shown in FIG. 3, the ship steering control device 30 controls the engines 10 and the auto-drive units 20 based on detection signals from the manipulation tools such as the accelerator lever 2, the steering 3, the joystick lever 4, and the shift lever 5. The ship steering control device 30 acquires information concerning the current position, the travelling speed, the traveling direction, the bow direction, and the turning amount of the ship hull 1 from the detection means 6 (the GNSS device 6*a* and the heading sensor 6*b*). Based on the detection results by the detection means 6 and manipulation of each manipulation tool, the ship steering control device 30 performs steering control of the ship 100.

The ship steering control device 30 stores programs and data for controlling the engines 10 and the auto-drive units 20. The ship steering control device 30 may be configured such that the CPU, the ROM, the RAM, and the HDD, for example, are connected by a bus, or may be constituted by, for example, a one-ship LSI.

The ship steering control device 30 is connected to the accelerator lever 2, the steering 3, the joystick lever 4, and the shift lever 5, for example, and acquires detection signals generated by sensors when these manipulation tools are manipulated.

Specifically, as shown in FIG. 3, the ship steering control device 30 is electrically connected to an accelerator sensor 51 for detecting a manipulation amount of the accelerator lever 2, a steering sensor 52 for detecting a rotation angle that is a manipulation amount of the steering 3, a sensor 53 for detecting a manipulation angle, a manipulation amount, a twist, and so forth of the joystick lever 4, and a lever sensor 54 for detecting a manipulation position of the shift lever 5, and acquires detection values based on detection signals transmitted from these sensors, as manipulation amounts.

Based on the manipulation amount (tilt angle) of the accelerator lever 2 acquired from the accelerator sensor 51, the ship steering control device 30 changes the number of revolutions of the engines 10 to thereby control the traveling speed of the ship hull 1. Based on the manipulation amount (rotation angle) of the steering 3 acquired from the steering sensor 52, the ship steering control device 30 changes the rotation angle of the auto-drive units 20 to thereby control the traveling direction of the ship hull 1. Based on the manipulation amount (a tilt direction, a tilt angle, a twist direction, and a twist amount) of the joystick lever 4 acquired from the sensor 53, the ship steering control device 30 changes the number of revolutions of the engines 10 and the propulsive power, the propulsive direction, and the rotation angle of the auto-drive units 20 to thereby control the traveling direction, the traveling speed, the turning direction, and the turning speed of the ship hull 1. Based on the manipulation position of the shift lever 5 acquired by the lever sensor 54, the ship steering control device 30 changes the number of revolutions of the engines 10 and the propulsive power and the propulsive direction of the auto-drive units 20 to thereby control the traveling direction and the traveling speed of the ship hull 1.

The ship steering control device 30 is electrically connected to the ECUs 15 of the engines 10, and acquires detection signals concerning operation statuses of the engines 10 acquired by the ECUs 15. On the other hand, the ship steering control device 30 transmits, to the ECUs 15, signals for turning power of the engines 10 (ECUs 15) on and off, and control signals for controlling the fuel adjusting value of the fuel feed pump and other devices in the engines 10. The ship steering control device 30 is electrically connected to the electromagnetic proportional control valves 28 of the auto-drive units 20, and based on control signals from the manipulation tools, controls the electromagnetic proportional control valves 28 for steering.

In this embodiment, the calibration switch 8 is connected to the ship steering control device 30. The calibration switch 8 is manipulation means for starting calibration of the ship 100, and is disposed near the joystick lever 4 or the steering 3, for example. The calibration switch 8 may be displayed on the touch-panel monitor 7.

Here, "calibration of the ship 100" in this embodiment means that the ship steering control device 30 simulates manipulation performed by the manipulation means such as the accelerator lever 2, the steering 3, the joystick lever 4, and the shift lever 5, and controls an operation statuses of the engines 10 and outputs and directions of action of propulsive power from the auto-drive units 20 based on a virtual manipulation amount of the manipulation means, and at the same time, corrects control values when a difference between an actual traveling amount and an actual traveling speed or an actual turning amount and an actual turning speed in a predetermined direction of the ship hull 1 based on the control values and an intended traveling amount and an intended traveling speed or an intended turning amount and an intended turning speed exceeds a threshold. That is, in executing calibration of the ship 100, manipulation of the manipulation means is simulated by the ship steering control device 30 without manipulation of the manipulation means by an operator so that calibration can be automatically performed.

Figure 4:
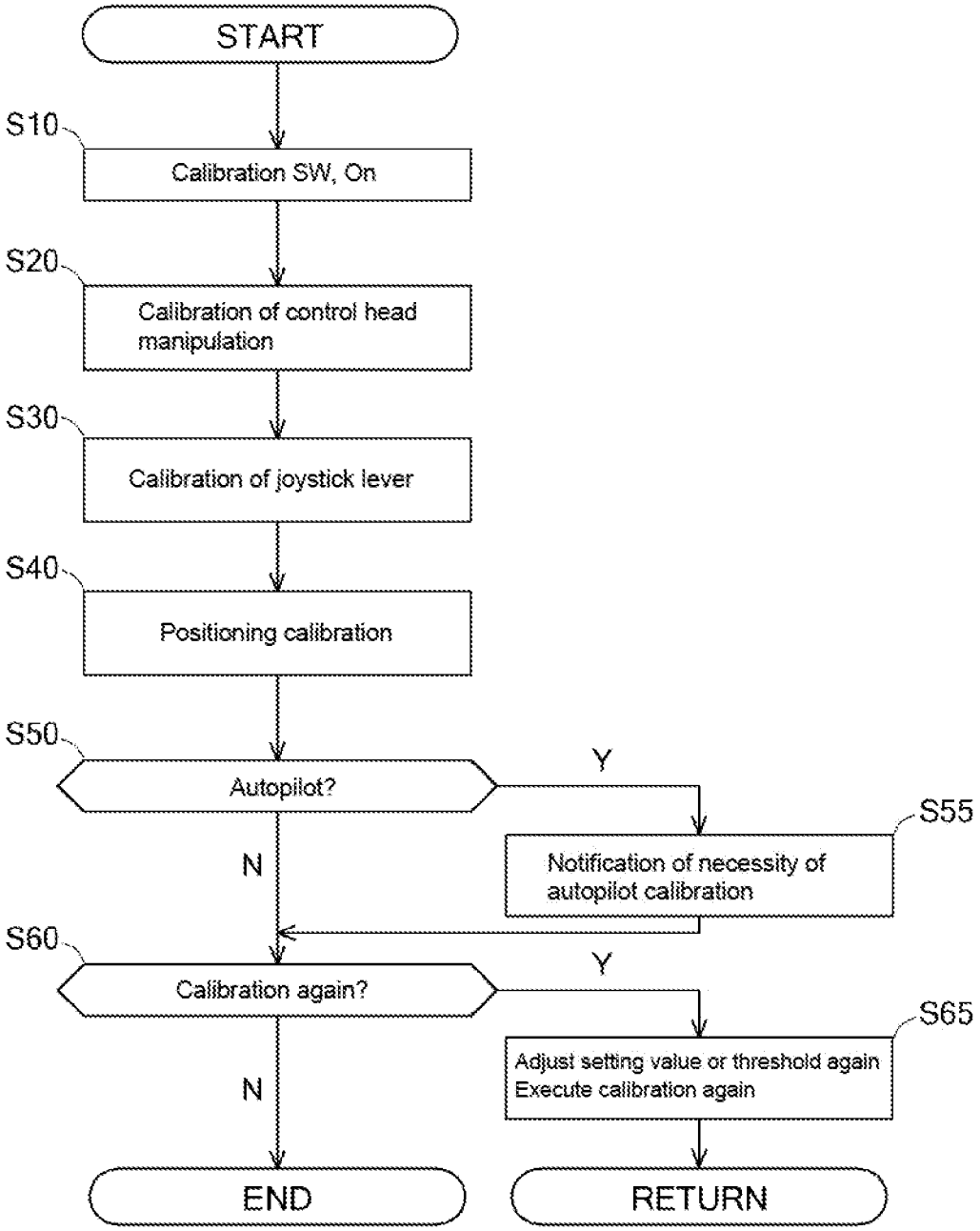
FIG. 4 A flowchart of automatic calibration.
Figure 5:
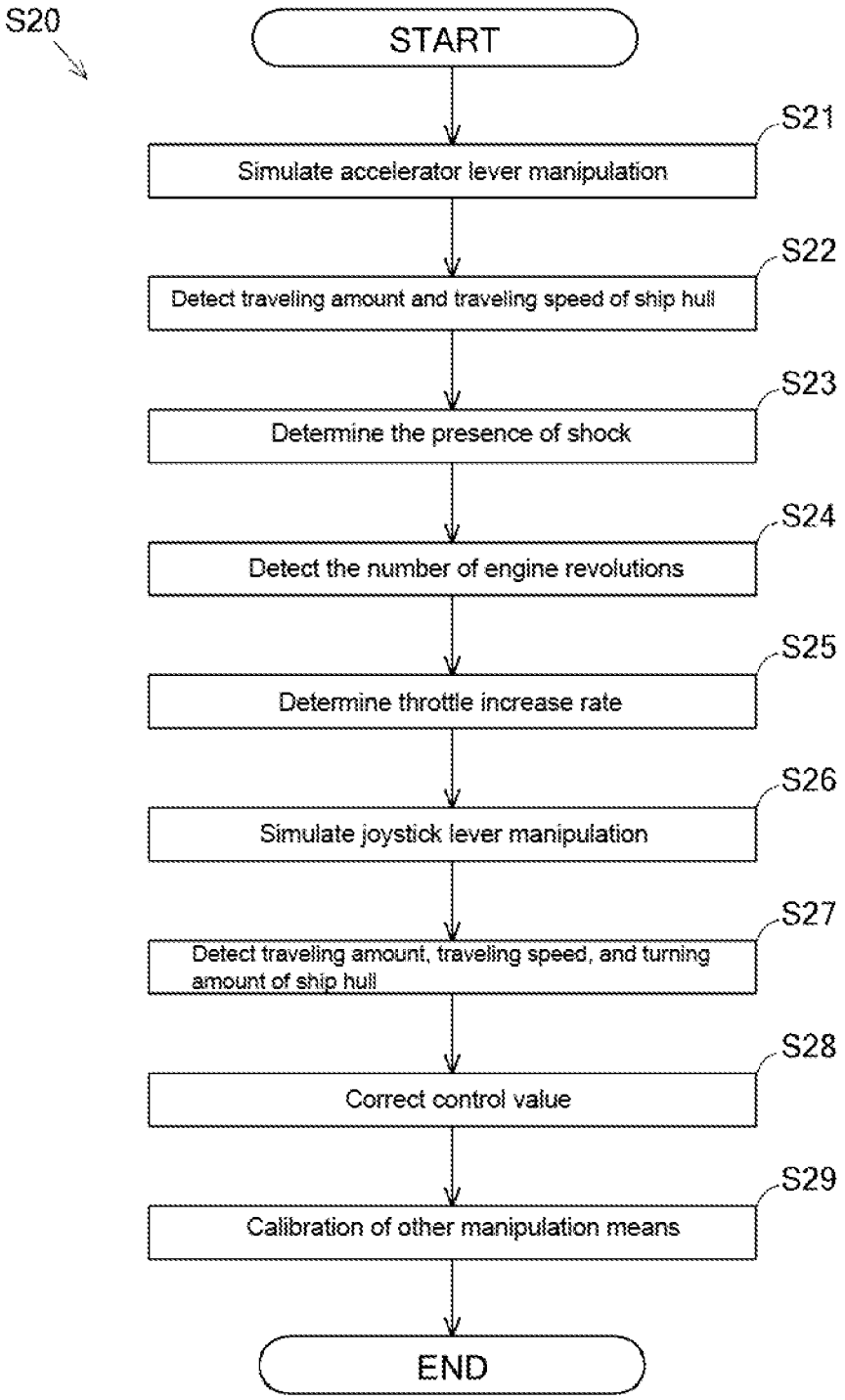
FIG. 5 A flowchart of calibration of control head manipulation.
Figure 6:
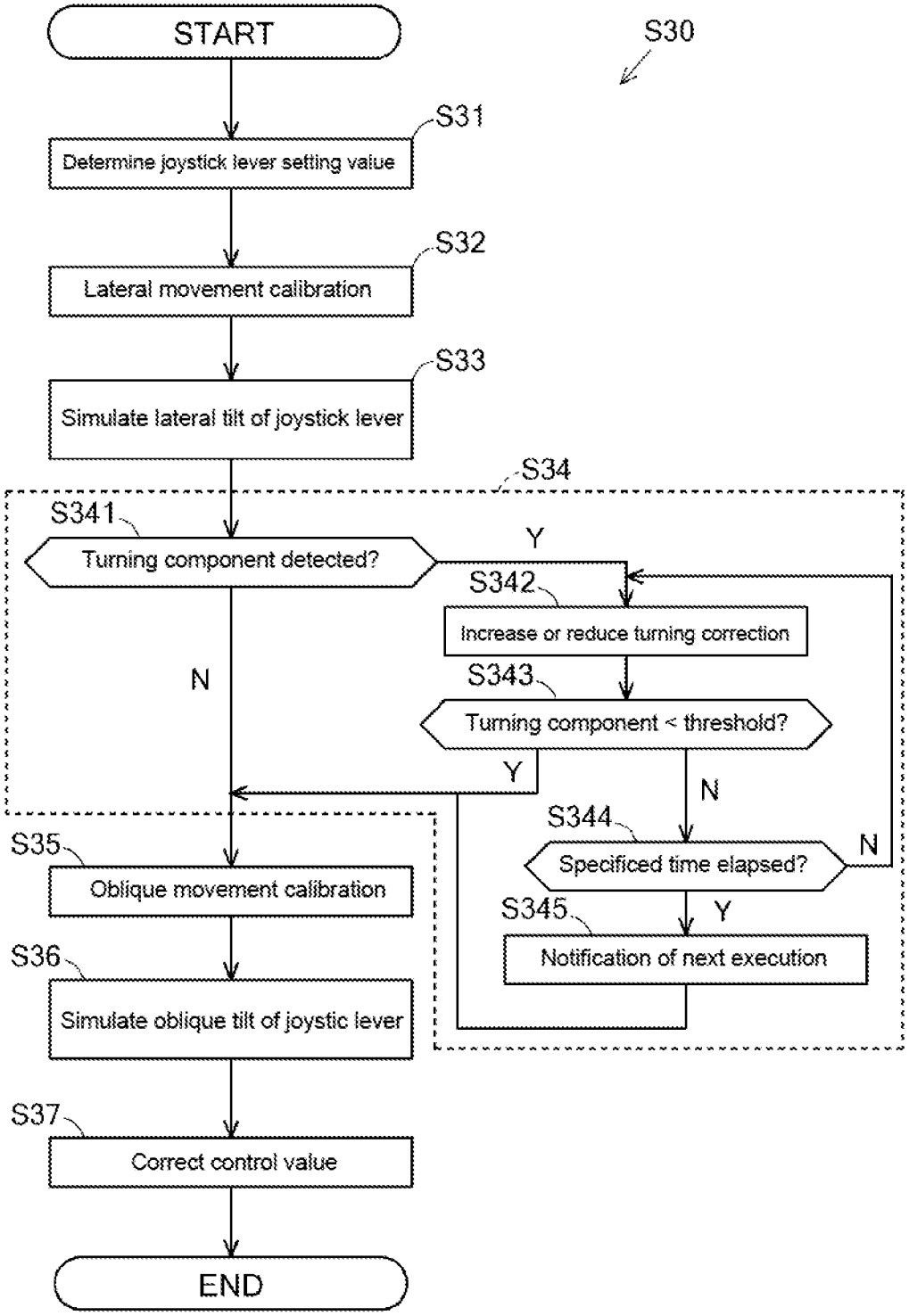
FIG. 6 A flowchart of calibration of joystick lever manipulation.

With reference to FIGS. 4 through 6, a flow of automatic calibration of the chip will be described.

FIG. 4 depicts an overall flow of the automatic calibration. First, step S10, it is detected that the calibration switch 8 is turned on (on state). The calibration switch 8 is preferably manipulated in a situation where the ship 100 is moved to a position where calibration can start, such as a calm place where the ship 100 can move to at least a radius of 100 m and no other ships are present around the ship 100. Alternatively, the monitor 7 may display a screen suggesting movement to a place where the ship 100 can move to a minimum necessary distance.

In step S20, calibration of control head manipulation is executed. The control head manipulation refers to manipulation of the accelerator lever 2, manipulation of the steering 3, manipulation of forward and rearward tilt of the joystick lever 4, and manipulation of the shift lever 5, for example. The calibration of the control head manipulation means that from a correlation between the manipulation amounts of these manipulation means and the traveling amount, the traveling speed, the turning amount, and the turning speed of the ship hull 1, an output, a timing of occurrence, and an acceleration of propulsive power exerted on the ship hull 1 by the engines 10 and the auto-drive units 20, and the rotation angle of the auto-drive units 20, for example, are calibrated.

Thereafter, in step S30, calibration of joystick lever manipulation is executed. In this step, calibration of lateral movement and then calibration of oblique movement of the joystick lever 4 are executed. Since calibration of the front-rear movement of the joystick lever 4 was executed in the calibration of control head manipulation in step S20, an allocation map of the manipulation directions of the joystick lever 4 and the traveling directions of the ship hull 1 can be created and stored in the ship steering control device 30 in step S30.

In step S40, positioning calibration is executed. In this step, calibration of fixed point holding of the ship 100 is executed, specifically, P control corrected value calculation calibration of turning at the current position, D control corrected value calculation calibration of turning at the current position, P control corrected value calculation calibration of front-rear movement, D control corrected value calculation calibration of front-rear movement, P control corrected value calculation calibration of lateral movement, D control corrected value calculation calibration of lateral movement, and θ control corrected value calculation calibration of both movement and turning are executed. These calibrations are also performed by similarly manipulating the manipulation means in simulation by the ship steering control device 30.

In step S50, it is determined whether the ship 100 includes an autopilot or not. If the autopilot is included (S50: Y), notification of necessity of autopilot calibration is issued in step S55. This is because autopilot calibration needs long-distance navigation, and thus, the autopilot calibration is preferably not included in a series of automatic calibration. If no autopilot is included (S50: N), the process proceeds to step S60.

In step S60, it is determined whether calibration needs to be performed again or not. This determination is performed on the assumption that calibration from step S20 to step S40 is not completed within a specified time. If calibration needs to be performed again (S60: Y), in step S65, a set value or a threshold in target calibration is adjusted again, and then this calibration is performed. For example, in a case where the travelling speed in steering by the joystick lever 4 is excessively high, adjustment of reducing setting of the maximum number of revolutions of the joystick lever 4 is performed. In a case where a shock occurs in steering by the accelerator lever 2, a throttle delay is increased, for example.

FIG. 5 depicts an example of a flow of calibration S20 in control head manipulation. In step S21, the ship steering control device 30 simulates manipulation of the accelerator lever 2 and moves the ship hull 1. To "simulate manipulation of the accelerator lever 2" means that a control value in a case where an operation of tilting the accelerator lever 2 to a predetermined amount is transmitted as a control signal to the ECUs 15 of the engines 10 and the auto-drive units 20, for example. In step S22, the traveling amount and the traveling speed of the ship hull 1 at this time are detected by the detection means 6.

Next, in step S23, based on a correlation between the amount of simulated manipulation of the accelerator lever 2 and the detected traveling amount and traveling speed, it is determined whether a shock occurs in the ship hull 1 or not, and a control value to be transmitted to the engines 10 (ECUs 15) is corrected. For example, if the traveling speed exceeds a predetermined threshold, it is determined that a shock occurs in the ship hull 1, and a throttle delay is increased, whereas if the traveling speed is the threshold or less, it is determined that no shock occurs in the ship hull 1, and the process proceeds to the next step.

In step S24, the number of revolutions of each engine 10 is detected. In step S25, based on a correlation between the simulated manipulation amount of the accelerator lever 2 and the detected number of engine revolutions, a rate of increase of the throttle is determined.

Thereafter, in step S26, the ship steering control device 30 simulates front-rear manipulation of the joystick lever 4 so that propulsive power is exerted on the ship hull 1 to cause the ship hull 1 to move forward or in reverse. To "simulate manipulation of the joystick lever 4" means, for example, that a control value in a case where an operation of tilting the joystick lever 4 to a predetermined amount in a predetermined direction is transmitted as a control signal to the ECUs 15 of the engines 10 and the auto-drive units 20, for example. In step S27, the traveling amount, the traveling speed, and the turning amount of the ship hull 1 at this time are detected by the detection means 6. In step S27, if a turning component of the ship hull 1 is detected, in step S28, control values concerning outputs of the engines 10 and/or rotation angles of the auto-drive units 20 are corrected, front-rear manipulation of the joystick lever 4 is simulated, and this process repeated until the turning component of the ship hull 1 falls within a predetermined range. In step S27, if no turning component of the ship hull 1 is detected, the control values of the engines 10 and the auto-drive units 20 are corrected until the traveling amount and the traveling speed of the ship hull 1 reach an intended travelling amount and an intended travelling speed of the joystick lever 4.

In step S29, calibration concerning manipulation of the steering 3, the shift lever 5, and other manipulation means are executed.

Calibration performed in calibration S20 of control head manipulation is performed as an adaptability test before shipment of a ship, and no calibration by an operator is not performed in a conventional method. This embodiment enables such calibration of control head manipulation so that calibration after shipment, that is, in a state where an operator can steer the ship, can be automatically performed for ships including different equipment in, for example, engines, transmissions, and propulsion unit.

FIG. 6 depicts a flow of calibration S30 of joystick lever manipulation. In step S31, a set value of the joystick lever 4 (e.g., a maximum rotation amount of the joystick lever 4) is determined.

In step S32, lateral movement calibration is executed. In step S33, the ship steering control device 30 simulates manipulation in laterally tilting the joystick lever 4, and propulsive power is exerted on the ship hull 1 so that the ship hull 1 moves laterally.

Thereafter, in step S34, a control value in lateral movement simulation manipulation is corrected. Specifically, in step S341, it is determined whether the detection means 6 detects turning of the ship hull 1 or not. If a turning component of the ship hull 1 is detected (S341: Y), in step S342, the turning correction is increased or reduced, and lateral propulsive power is exerted on the ship hull 1 again. Specifically, control values concerning outputs of propulsive power from the auto-drive units 20 and directions of action of the propulsive power are changed so that lateral propulsive power is exerted on the ship hull 1 again. Thereafter, in step S343, it is determined whether a turning component at this time is smaller than a predetermined threshold or not.

If the turning component is the predetermined threshold or more (S343: N), in step S344, it is determined whether a specified time has elapsed from the calibration start or not. If the specified time has not elapsed (S344: N), the process returns to step S342 again, and steps S342 and S343 are repeated until the turning component of the ship hull 1 is within the predetermined threshold. On the other hand, if the specified time has elapsed (S344: Y), lateral movement calibration is finished, and notification of necessity of next execution of calibration is issued (S345), and the process proceeds to step S35. If the turning component is less than the threshold (S343: Y), the process also proceeds to step S35.

Subsequently, in step S35, oblique movement calibration is executed. In step S36, the ship steering control device 30 simulates manipulation in obliquely tilting the joystick lever 4, and oblique propulsive power is exerted on the ship hull 1 so that the ship hull 1 moves obliquely. Then, in step S37, in a manner similar to the control value correction in lateral movement simulation manipulation in step S34, control values in oblique movement simulation manipulation are corrected.

In a case where control values are corrected and steering is performed by simulation manipulation again, this steering is performed after setting the ship 100 stationary for each test so as to prevent an inertial operation occurring in the ship hull 1 from affecting calibration.

As described above, in this embodiment, calibration of the ship 100 can be automatically executed only by operator's manipulation of turning the calibration switch 8 on without actually manipulating the manipulation means such as the accelerator lever 2, the steering 3, the joystick lever 4, and the shift lever 5.

In addition, the amounts of movement such as longitudinal (front-rear), lateral, and oblique movements of ship 100 can be detected by using the detection means 6 (the GNSS device 6*a*), independently of sense of an operator. In addition, adequacy determination of calibration can be automatically performed. Accordingly, it is possible to provide a significantly general-purpose ship steering device covering elements that are not easily known by an operator, such as a difference in behavior depending on the shape of the ship hull 1.

In addition, in this embodiment, the detection means 6 for detecting the current position and orientation of the ship hull 1 and the calibration switch 8 for starting calibration are provided, and the ship steering control device 30 executes various calibrations. Alternatively, these components may be prepared separately and additionally attached at initial setting of the ship 100 or at execution of calibration of the ship 100. In this case, a configuration which includes the calibration switch 8 and in which a control device for executing calibration is externally connected to the ship steering control device 30 (plug and play type) can be employed.

INDUSTRIAL APPLICABILITY

Some aspects of the present invention are applicable to a ship steering device and a ship including the ship steering device.

REFERENCE SIGNS LIST

1 ship hull
2 accelerator lever
4 joystick lever
8 calibration switch (manipulation means)
10 engine
20 auto-drive unit
30 ship steering control device
100 ship

The invention claimed is:

1. A ship steering device comprising:
an engine;
a propulsion unit configured to exert propulsive power on a ship hull by power from the engine;
detection means for detecting a current position and an orientation of the ship hull;
a control device configured to control an output of the engine and propulsive power of the propulsion unit; and
manipulation means configured to start calibration of a ship, wherein
when the control device detects that the manipulation means is turned on, the control device controls the engine and the propulsion unit to cause the ship hull to move in a predetermined direction or to turn, and
if a difference between
a traveling amount and a travelling speed or a turning amount and a turning speed in the predetermined direction and
an intended traveling amount and an intended traveling speed or an intended turning amount and an intended turning speed
exceeds a predetermined value, the control device corrects control values of the engine and the propulsion unit.

2. The ship steering device according to claim 1, further comprising manipulation means including an accelerator device configured to change number of revolutions of the engine, wherein
the control device simulates manipulation of the accelerator device to control the engine and the propulsion unit, and based on a correlation among an amount of the simulated manipulation of the accelerator device and a traveling amount and a traveling speed of the ship hull, the control device corrects a control value of the engine.

3. A ship comprising the ship steering device according to claim 1.

4. A ship comprising the ship steering device according to claim 2.

* * * * *